US008668098B2

(12) United States Patent
Wand

(10) Patent No.: US 8,668,098 B2
(45) Date of Patent: Mar. 11, 2014

(54) ERGONOMIC BOTTLE CAP

(75) Inventor: Assaf Wand, Palo Alto, CA (US)

(73) Assignee: Sabi, Inc., Palo Alto, CA (US)

( * ) Notice: Subject to any disclaimer, the term of this patent is extended or adjusted under 35 U.S.C. 154(b) by 69 days.

(21) Appl. No.: 13/252,637

(22) Filed: Oct. 4, 2011

(65) Prior Publication Data

US 2013/0082023 A1 Apr. 4, 2013

(51) Int. Cl.
*B65D 41/00* (2006.01)
*B65D 41/04* (2006.01)

(52) U.S. Cl.
USPC ..... 215/305; 215/329; 220/212.5

(58) Field of Classification Search
USPC ..... 215/305, 329; 220/212.5; D9/443
See application file for complete search history.

(56) References Cited

U.S. PATENT DOCUMENTS

| | | | | | |
|---|---|---|---|---|---|
| D157,065 | S | * | 1/1950 | Medgyes | D9/443 |
| D192,758 | S | * | 5/1962 | Rijnovan | D9/443 |
| D351,793 | S | * | 10/1994 | Stoller | D9/443 |
| 5,431,305 | A | * | 7/1995 | Kaminski | 222/109 |
| 5,941,404 | A | * | 8/1999 | Charrette | 215/305 |
| D512,912 | S | * | 12/2005 | Biesecker et al. | D9/443 |
| D513,985 | S | * | 1/2006 | Erdie | D9/439 |
| D613,160 | S | * | 4/2010 | Ablo | D9/443 |
| D615,406 | S | * | 5/2010 | Leventhal et al. | D9/503 |
| D621,706 | S | * | 8/2010 | Breckan | D9/443 |
| D636,264 | S | * | 4/2011 | Wassum et al. | D9/453 |
| D640,552 | S | * | 6/2011 | Eiteljorg et al. | D9/443 |
| 2004/0200797 | A1 | * | 10/2004 | Hicks et al. | 215/305 |

FOREIGN PATENT DOCUMENTS

| | | | |
|---|---|---|---|
| EP | 0199408 | A1 | 4/2011 |
| GB | 2403202 | A | 10/1986 |
| JP | 09040084 | A2 | 2/1997 |
| JP | 2000281115 | A2 | 10/2000 |
| JP | 2000309395 | A2 | 11/2000 |
| JP | 2011073779 | A2 | 5/2002 |
| JP | 2004043008 | A2 | 2/2004 |
| JP | 2002145270 | A2 | 12/2004 |
| JP | 2004338763 | A2 | 12/2004 |
| JP | 2009007065 | A2 | 12/2004 |
| JP | 2004338763 | A2 | 12/2005 |
| JP | 2006036264 | A2 | 2/2006 |
| JP | 2005350081 | A2 | 1/2009 |
| JP | 2009126517 | A2 | 6/2009 |
| JP | 2010240212 | A2 | 10/2010 |
| JP | 2011025963 | A2 | 2/2011 |
| NL | 1035643 | | 3/2010 |

* cited by examiner

*Primary Examiner* — Mickey Yu
*Assistant Examiner* — Niki Eloshway
(74) *Attorney, Agent, or Firm* — Robert G. Lev

(57) ABSTRACT

A polymer lid for capping the mouth of a PET bottle having a neck with a male thread, the lid comprising a threaded female cylindrical section for engaging the male thread of the neck; an outer surface comprising an arcuate skirt consisting of at least three quarters (270°) of a torroidal cylindrical section around the female cylindrical section; and further consisting of a protrusion having first and second surfaces than meet at an apex whose maximum extension protrudes between 1 mm and 5 mm from the inner cylindrical female surface; the protrusion for engagement by a thumb of a person attempting to open the bottle, enabling increased torque in a counter-clockwise direction for removal of the lid from a PET bottle.

4 Claims, 2 Drawing Sheets

ERGONOMIC BOTTLE CAP

FELD OF THE INVENTION

The present invention is directed to a plastic cap for a PET bottle, particularly for fizzy drinks.

BACKGROUND

Twist-off bottle caps were introduced in the 1960s in Germany. They are sealed on the bottle with screw threads instead of engaging a flange in the manner of a crown cap.

Polyethylene terephthalate, also known as PET was developed in 1941 and since the 1970s, soda bottles have been made by stretch blow molding, PET. For sealing blown PET bottles, which are widely used for packaging carbonated drinks, such caps are injection molded from plastic.

The number of threads in fizzy drink bottles are standardized. The dimension of the cap for a PET bottle is determined by the mouth of the bottle which is designed to be easily poured from, but, for packaging fizzy drinks, is relatively small to minimizing gas escaping.

Such lids vary somewhat, but for capping bottles of carbonated beverages, are typically about 15 mm high and approximately 30 mm in internal dimensions. They have a circular top surface and a torroidal skirt extending there around with a screw thread on the inner surface for engaging the corresponding male thread around the neck of the bottle. The number of threads per unit length and their pitch is standardized, but occasionally the threads are incomplete for aesthetic reasons as much as anything. Such lids are also provided with a polyethylene insert which is squashed against the mouth of the bottle providing a pressure resistant, water tight, and virtually $CO_2$ tight seal.

Of necessity, such caps are tight fitting to the bottle neck thereunder to prevent the $CO_2$ from escaping from carbonated beverages contained within the bottle.

Typically, the outer surface of the skirt is fluted to make it easier to grip. The edge joining the torroidal surface and the flat top is typically curved and sometimes the torroidal surface is slightly frustoconical, tapering slightly towards the substantially flat surface. The skirt typically terminates with a smooth ring. Such caps are produced by injection moulding.

It is well documented that the infirm, elderly, handicapped and children sometimes have difficulty opening such bottles. Furthermore, such bottles are typically 1½ or 2 liter capacity and are designed to be closable so that the contents need not be consumed at once. To retain some of the fizz, and to provide some shelf life without all the carbon dioxide escaping, it is necessary to tightly close such bottles once opened, and this is also difficult for the physically challenged to accomplish since the fluted skirt which is generally only one or two millimeters wider in diameter than the bottle neck itself, does not provide much grip nor much leverage.

There are a number of patents that relate to lids with easy grips for aiding opening by the infirm or children.

For example JP2009007065A2 provides a lid with a polygonal external surface for easy grip. Such lids provide short flat surfaces separated by large obtuse angles for gripping, and this provides only slightly more grip than the fluted skirt solution. Fingers typically slip off rather than find a purchase. Such lids are also inappropriate looking for bottles, since the angularity of the lid contrasts, rather than complements the smooth curves of the bottle. Indeed lids with polygonal shapes are reminiscent of nuts and bolts and are more appropriate for lubricants, oils and petroleum, distilled water for car batteries, antifreeze and other fluids for use in machinery rather than for capping bottles of beverages.

JP2005350081A2 describes a foam cap made from foam plastic for recycling purposes that has a larger external diameter and therefore makes providing more torque somewhat easier. Such a lid is, however, bulky and unaesthetic.

The literature also includes a number of lids for PET bottles that have appendages for other functions. For example, JP2004338763A2 and JP2000281115A2 describe lids with integral hooks. NL1035643C2 describes a lid with an integral clip. JP2004043008A2, JP2006036264A2 and GB2403202A describe lids that also serve as drinking Cups. Such lids are more massive and enable an increased torque that aids leverage, making opening easier but this is not the main point of such appendages which are usually quite bulky. They are considerably more expensive to manufacture than regular lids, being more bulky and using more raw material. They are also difficult to manufacture putting the costs up somewhat.

JP2010240212A2 titled "Lid Member Mounting Toy" describes a lid that serves as the enlarged head of a doll type toy, with a small body attached thereto, perpendicularly. Such a cap will be expensive to manufacture.

Furthermore, it will be appreciated that many soft drinks contain large amounts of sugar, or in diet versions, contain artificial sweeteners that have been claimed to be unhealthy or even carcinogenic. Some soft drinks that are frequently vended in PET bottles contain phosphoric acid and caffeine and have been accused as being addictive. Manufactures of such drinks prefer to aim their marketing campaigns to young adults rather than to children. In addition to high construction costs, a doll like lid is rather gimmicky and not appropriate for a drink aimed at adults.

A number of tools have been proposed that engage a bottle lid and provide additional leverage, thereby facilitating opening such bottles. Such tools include

JP2000309395A2 , JP2009126517A2, JP2011025963A2, JP09040084A2

JP2004359265A2describes yet another PET bottle cap remover. JP2004338763A2 describes a C shaped adapter with a protruding hook made from polyester resin. The C shaped part engages the bottle cap and the protruding hook helps provide leverage. The C shaped part engages the bottle cap and the protruding hook helps provide leverage.

JP2002145270A2 describes a bottle cap remover built into the base of a PET bottle, so one bottle can be used to remove the lid of another bottle.

JP2011073779A2 describes a bottle opener that can be reversed and used as a replacement cap. The device extends radially further than the skirt of a regular PET bottle and thereby facilitates ease of opening.

Another approach is described in EP0199408A1 which describes using a lubricant to make lid removal easier.

The plethora of approaches that have been suggested that address the issue of removing tight fitting lids from PET bottles, indicates that there is a real issue with the ubiquitous caps that are widely used.

There is a need for a more easily removable lid appropriate for PET bottles containing beverages aimed at the sophisticated adult market and the present invention addresses this need.

SUMMARY OF THE INVENTION

A polymer lid for capping the mouth of a PET bottle having a neck with a male thread; the lid comprising a threaded female cylindrical section for engaging the male thread of the neck; an outer surface comprising an arcuate skirt consisting of at least three quarters (270°) of a torroidal cylindrical section around the female cylindrical section; and further consisting of a protrusion having first and second surfaces than meet at an apex whose maximum extension protrudes between 1 mm and 5 mm from the inner cylindrical female surface; the protrusion for engagement by a thumb of a person attempting to open the bottle, enabling increased torque in a counter-clockwise direction for removal of the lid from a PET bottle.

Typically, the first surface connecting the torroidal cylindrical surface with the maximum extent of the protrusion for engaging a thumb when turning the lid in a counterclockwise direction to open the bottle, is concave.

Typically, the second surface connecting the torroidal cylindrical surface with the maximum extent of the protrusion for engaging a thumb when turning the lid in a clockwise direction to close the bottle, is convex.

Typically, the arcuate skirt smoothly merges with the first and second surfaces.

Typically, the apex of the protrusion is gently rounded.

Optionally, at least part of curved surface comprising the arcuate skirt, the first and the second surfaces of the protrusion is fluted.

Optionally, the apex of the protrusion between the first and second arcuate surfaces slopes in opposite direction and approximately perpendicular to pitch of the thread.

BRIEF DESCRIPTION OF FIGURES

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings:

FIG. 2A is an isometric projection of the lid

FIG. 2B is a side view of the lid

FIG. 2C is a top view

FIG. 2D is a bottom view of the lid

FIG. 2E is a rear view showing the how the protrusion slants downwards, and

FIG. 2F is a front view of the lid, showing how from the front, the protrusion is not seen and the lid looks totally standard.

DESCRIPTION OF PREFERRED EMBODIMENTS

Figure 1:
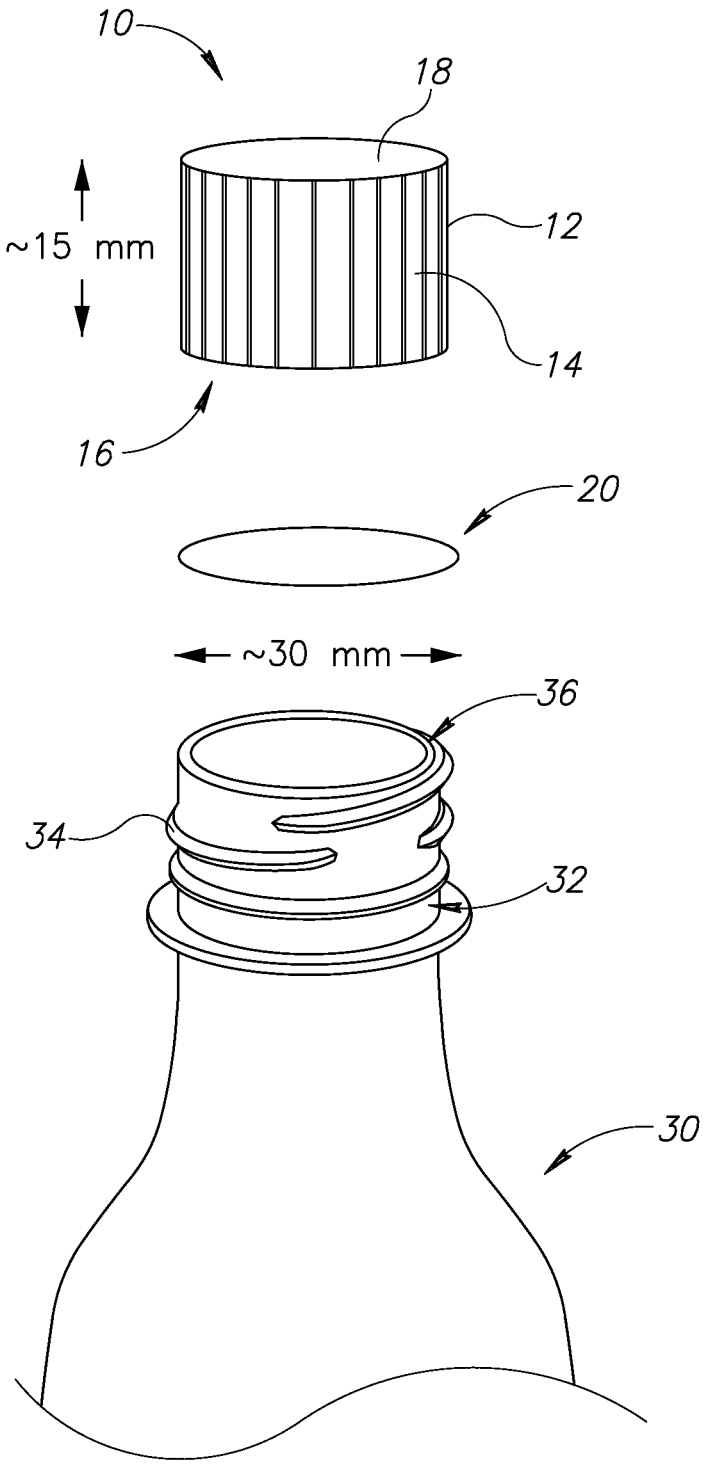
FIG.1 PRIOR ART
FIG. 1 shows a conventional torroidal lid for capping a PET bottle, in accordance with the prior art.
Figure 2A:
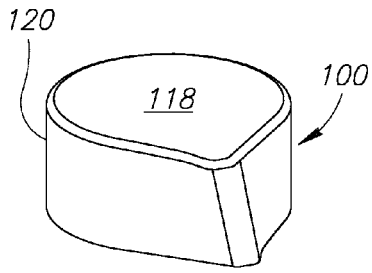
FIG. 2A-F show an improved lid for capping a PET bottle, where.
Figure 2B:
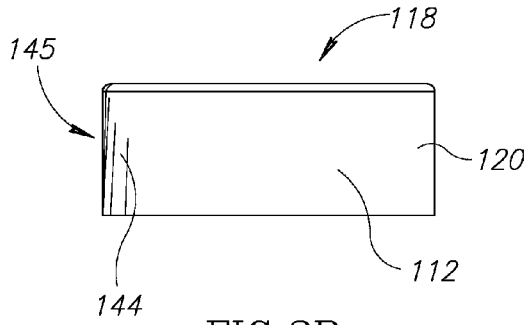
Figure 2C:
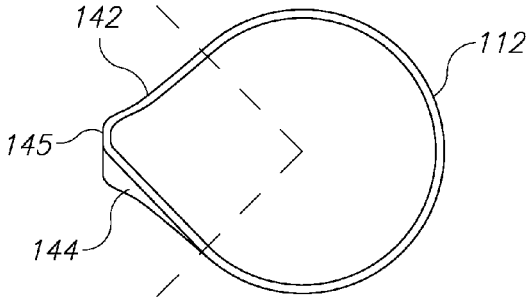
Figure 2F:
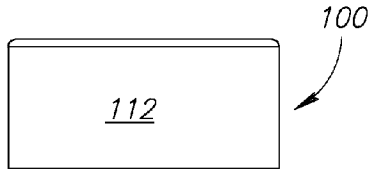
Figure 2D:
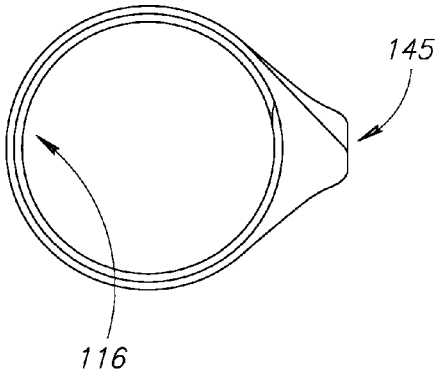
Figure 2E:
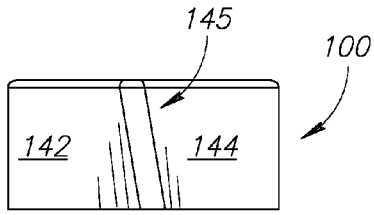

With reference to FIG. 1, a prior art lid 10 for capping the mouth of a PET bottle 30 is shown.

The neck 32 of a PET bottle 30 is provided with a male thread 34 and the lid 10 for capping the bottle is provided with a corresponding female thread on its inner surface, for engaging the male thread 34 around the neck 32 of the bottle 30.

The threaded sections of both neck 32 and lid 10 are torroidal and may be cylindrical or have a slightly tapered, frustoconical shape. The number and pitch of the threads are largely standardized. Typically the external diameter of the neck 32 (inside diameter of the lid) is about 30 mm. The height of the lid 10 is about 15 mm.

Such lids 10 have a cylindrical outer surface or skirt 12 that has a diameter that is typically 1-2 mm wider than the diameter of the bottle neck 32. The skirt 12 is often fluted, with striations 14 perpendicular to the mouth 16 of the cap 10, for facilitating grip. The top surface 18 of the cap 10 is a circular disk shape that may be slightly domed. Such caps 10 are made by injection molding.

The lid 10 is particularly suitable for capping PET bottles for carbonated beverages. To provide a substantially air tight seal to prevent escape of carbon dioxide, a soft plastic disk 20 may be provided, that fits within the cap 10 and provides an air-tight seal against the lip 36 around the mouth of the bottle.

Despite the fluting striations 14, many people, especially the elderly, infirm and children, have difficulty in opening such bottles 30. The fingers find difficulty in making a purchase on the lid 10 and applying sufficient torque to unscrew the lid 10 from the neck 32 of the bottle 30.

With reference to FIGS. 2A-F, an improved lid or cap 100 in accordance with a preferred embodiment of the invention is shown.

The improved lid 100 consists of an outer top surface 118 surrounded by a skirt 120 that may be fluted with striations 114, and an inner threaded female cylindrical section 116 for engages the male threads 34 around the neck 32 of a bottle 30 mutatis mutandis. The skirt 120 of the improved lid 100 has been designed to make it easier to purchase a grip and to apply the necessary turning force (torque). Instead of having a simple 360° cylindrical torroidal skirt 12 (FIG. 1) as with the ubiquitous lids 10 of the prior art., the skirt 120 of the improved lid includes an arcuate skirt section 112 consisting of only about three quarters (270°) of a torroidal cylindrical section, and further consisting of a gradually tapering protrusion 140 having first 142 and second 144 curved surfaces than extend from the cylindrical torroidal skirt section 112 that meet at an apex 145 whose maximum extension protrudes between 1 mm and 5 mm from the inner threaded cylindrical female surface 116. The surface 12 of the protrusion 140 is engaged by the thumb of a person attempting to remove the lid 100 from a bottle 30, enabling increased torque in a counter-clockwise direction for removal of the lid 100 from a PET bottle.

Usefully, the first surface 142 connecting the torroidal cylindrical surface with the maximum extent (apex) of the protrusion 145 for engaging a thumb when turning the lid 100 in a counterclockwise direction to open the bottle 30 is concave. This prevents the thumb from slipping and makes applying an appropriate torque far easier than with cylindrical lids 10 or polygonal lids of the prior art.

It will be appreciated that because the first 142 and second 144 surfaces are rather larger than the sides of polygonal lids it is much easier to apply a torque via these surfaces 142, 144 to loosen and tighten the lid 100 when opening and closing the bottle 30.

The second surface 144 connecting the torroidal cylindrical surface with the maximum extent 145 of the protrusion 140 allows engaging a thumb when turning the lid 100 in a clockwise direction to close the bottle 30. This second surface

144 may also be concave for maximum closing torque, but it has been found acceptable for this surface to be flat or convex as well.

It is appreciated that preferably the cylindrical arc shaped skirt 112 gently and smoothly merges with the first and second surfaces 142, 144 without abrupt transition.

The first and second surfaces 142, 144 of the protrusion 140 meet at an apex 145 that is preferably gently rounded, having a radius of curvature of up to about 6 mm, but optionally rather less.

At least part of the curved surface 120 consisting of the arcuate skirt 112 and the first and the second surfaces 142, 144 of the protrusion may be fluted, in a similar manner to the torroidal skirts of regular prior art lids, thereby facilitating good grip, particularly where bottle, or hand or both are slightly wet. For aesthetic reasons, the entire curved surface 120 may be fluted, but because of the protrusion 140, none of it is really required to be fluted to obtain purchase.

To further facilitate applying a torque and not slipping, the apex 145 protrusion 140 between the first and second arcuate surfaces 142, 144 may slope slightly, in the opposite direction and approximately perpendicular to the pitch of the thread 116. This aids both tightening and loosening of the lid 100.

The lid 100 of the invention is easier to apply a torque to for opening and closing bottles 30, than conventional cylindrical lids 10 of the prior art. It is also easier to engage than polygonal lids. Furthermore, since the protrusion has elegantly curving sides 142, 144, it is more aesthetically pleasing than a polygonal solution or an angular protrusion.

Thus the present invention is capable of a number of variations and the scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

I claim:

1. A polymer lid for capping the mouth of a PET bottle having a neck with a male thread, the lid comprising an inner threaded female cylindrical section having a lid thread for engaging the male thread of the neck;

an outer surface comprising an arcuate skirt consisting of at least three quarters)(270°) of a torroidal cylindrical section around the female cylindrical section;

and further consisting of a gradually tapering protrusion having first and second arcuate concave surfaces that meet at an apex whose maximum extension protrudes between 1 mm and 5 mm from the inner threaded female cylindrical section; wherein the apex of the gradually tapering protrusion between the first and second concave arcuate surfaces constitutes a substantially straight structure from top to bottom, and slopes slightly in a direction opposite a direction of closure of said lid thread and approximately perpendicular to a pitch of the lid thread; the protrusion being configured for engagement by a thumb of a person attempting to open the bottle, enabling increased torque along said lid thread and said male thread in a counter-clockwise direction for removal of the lid from a PET bottle.

2. The polymer lid of claim 1 wherein the arcuate skirt gently merges with the first and second arcuate concave surfaces.

3. The polymer lid of claim 1 wherein the apex of the protrusion is gently rounded.

4. The polymer lid of claim 1 wherein at least part of the outer surface comprising the arcuate skirt, the first and the second arcuate concave surfaces of the protrusion is fluted.

* * * * *